US010538386B2

(12) United States Patent
Wells

(10) Patent No.: US 10,538,386 B2
(45) Date of Patent: Jan. 21, 2020

(54) WASTE BIN

(71) Applicant: Colin Wells, Littlehampton West Sussex (GB)

(72) Inventor: Colin Wells, Littlehampton West Sussex (GB)

( * ) Notice: Subject to any disclaimer, the term of this patent is extended or adjusted under 35 U.S.C. 154(b) by 0 days.

(21) Appl. No.: 15/547,960

(22) PCT Filed: Feb. 2, 2016

(86) PCT No.: PCT/GB2016/050237
§ 371 (c)(1),
(2) Date: Aug. 1, 2017

(87) PCT Pub. No.: WO2016/124911
PCT Pub. Date: Aug. 11, 2016

(65) Prior Publication Data

US 2018/0022546 A1 Jan. 25, 2018

(30) Foreign Application Priority Data

Feb. 2, 2015 (GB) ..... 1501640.5
Jun. 26, 2015 (GB) ..... 1511261.8

(51) Int. Cl.
*B65F 1/16* (2006.01)
*B65F 1/02* (2006.01)

(52) U.S. Cl.
CPC ..... *B65F 1/1615* (2013.01); *B65F 1/02* (2013.01); *B65F 2210/167* (2013.01); *B65F 2220/102* (2013.01); *B65F 2220/1063* (2013.01); *B65F 2250/106* (2013.01); *B65F 2250/108* (2013.01)

(58) Field of Classification Search
CPC ..... B65F 1/1615; B65F 2210/167; B65F 2220/102; B65F 2220/1063
USPC ..... 229/247
See application file for complete search history.

(56) References Cited

U.S. PATENT DOCUMENTS 2,979,247 A * 4/1961 Pellaton ..... B65D 5/606 229/117.33
3,439,866 A * 4/1969 Kuhnle ..... B65D 31/12 206/232
3,456,867 A * 7/1969 Repko ..... A61F 15/001 383/203
4,410,086 A 10/1983 Simpson
4,498,585 A * 2/1985 Gordon ..... B65D 5/069 206/518
4,638,912 A * 1/1987 Graf ..... B65D 33/16 206/524.8
4,930,906 A 6/1990 Hemphill
5,425,468 A 6/1995 Birkel et al.
(Continued)

FOREIGN PATENT DOCUMENTS

DE 20318543 3/2004
JP H04164701 6/1992
(Continued)

*Primary Examiner* — Derek J Battisti
(74) *Attorney, Agent, or Firm* — Diederiks & Whitelaw, PLC.

(57) ABSTRACT

A waste container comprising an opening, a permanent closure member, and an adhesive attached to the closure member for irreversibly sealing the closure member to another part of the container so as to, in use, permanently close the opening in the container.

13 Claims, 7 Drawing Sheets

(56) References Cited

U.S. PATENT DOCUMENTS

| | | | | |
|---|---|---|---|---|
| 5,683,339 | A * | 11/1997 | Mills | B65D 5/061 493/156 |
| 5,720,557 | A | 2/1998 | Simonsen | |
| 5,816,487 | A * | 10/1998 | Skinner | B65D 5/068 229/248 |
| 5,913,606 | A | 6/1999 | Nicholson | |
| 6,047,883 | A * | 4/2000 | Calvert | B65D 5/061 229/123.3 |
| 6,341,692 | B1 * | 1/2002 | Miller | B65D 5/061 206/431 |
| 7,445,116 | B2 | 11/2008 | Dansaert et al. | |
| 7,458,480 | B2 | 12/2008 | Nguyen | |
| 7,644,834 | B2 | 1/2010 | Castora et al. | |
| 7,891,543 | B2 * | 2/2011 | Abel | B65D 5/068 229/137 |
| 7,914,207 | B1 | 3/2011 | Beam | |
| 8,813,986 | B2 | 8/2014 | Liscio et al. | |
| 2003/0111521 | A1 * | 6/2003 | Holmes | B65D 5/0254 229/117 |
| 2004/0134923 | A1 | 7/2004 | Aquino et al. | |
| 2010/0054638 | A1 | 3/2010 | Duggan | |
| 2013/0156350 | A1 | 6/2013 | Turner | |
| 2013/0264380 | A1 * | 10/2013 | Dolby | B65D 3/268 229/247 |
| 2014/0008425 | A1 * | 1/2014 | Clark | B65D 5/0085 229/247 |

FOREIGN PATENT DOCUMENTS

| | | |
|---|---|---|
| JP | H07206101 | 8/1995 |
| JP | H11299665 | 11/1999 |
| JP | 2001072201 | 3/2001 |
| WO | 89/01905 | 3/1989 |
| WO | 96/25894 | 8/1996 |
| WO | 2008/071933 | 6/2008 |
| WO | 2008/143945 | 11/2008 |

* cited by examiner

Fig. 2.1
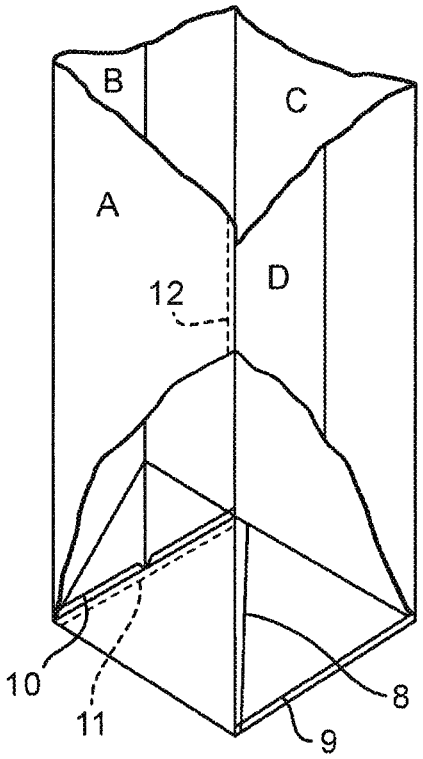
Fig. 2.2
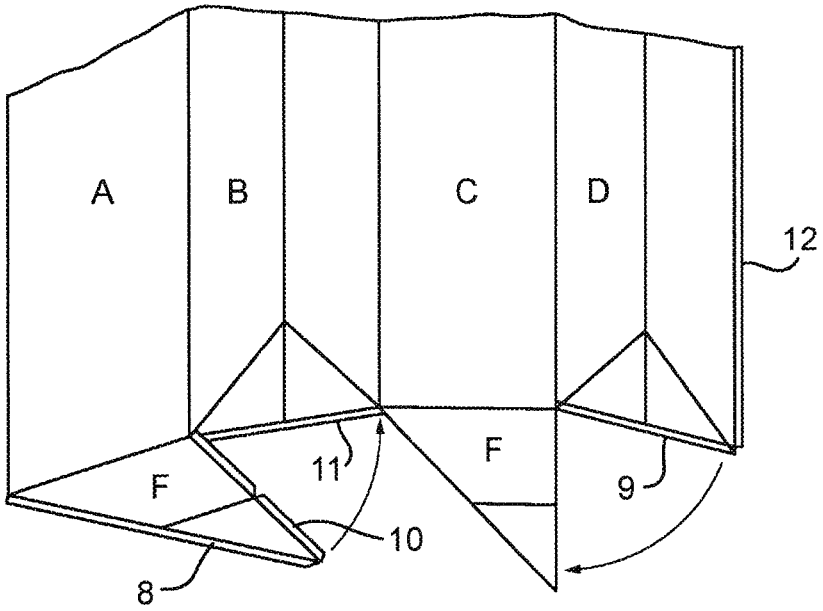

Fig. 3.1
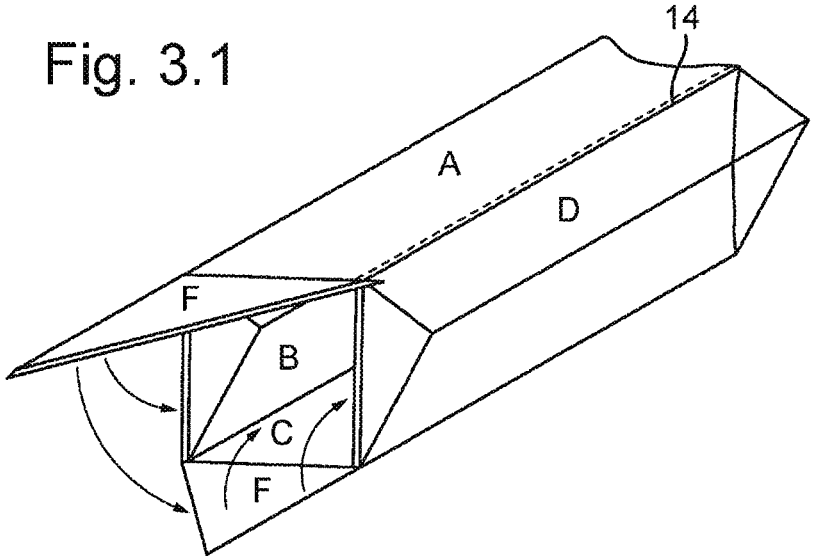
Fig. 3.2
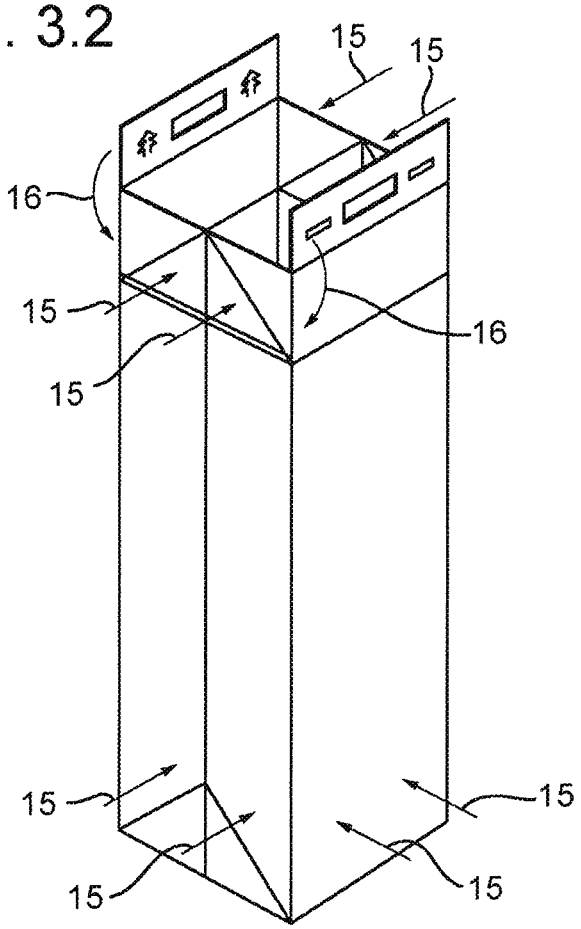

Fig. 4.1
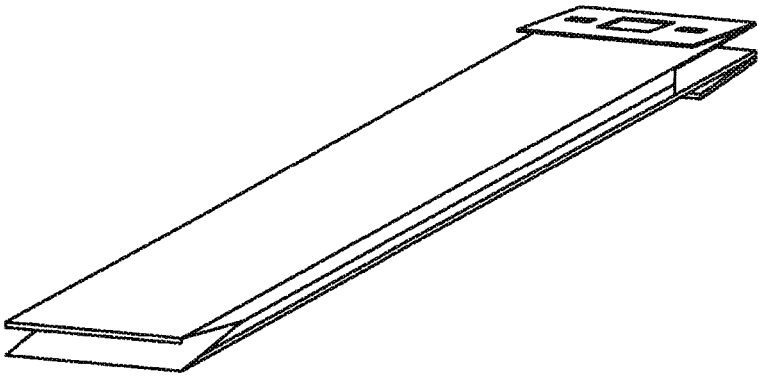
Fig. 4.2
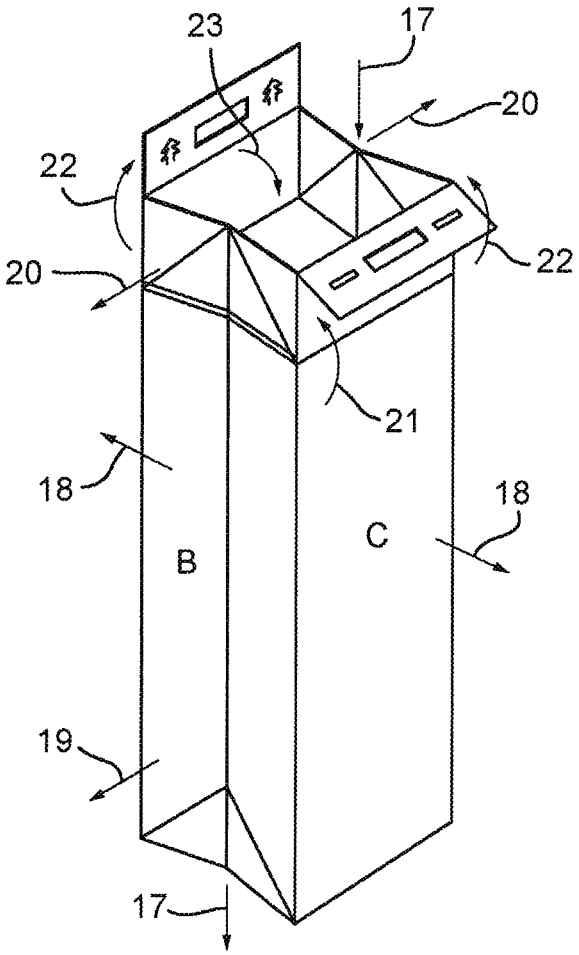

Fig. 5.1
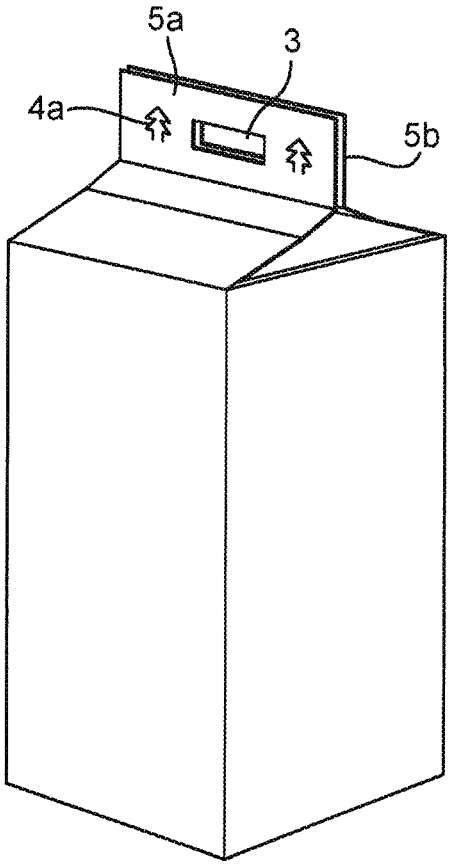

Fig. 5.3
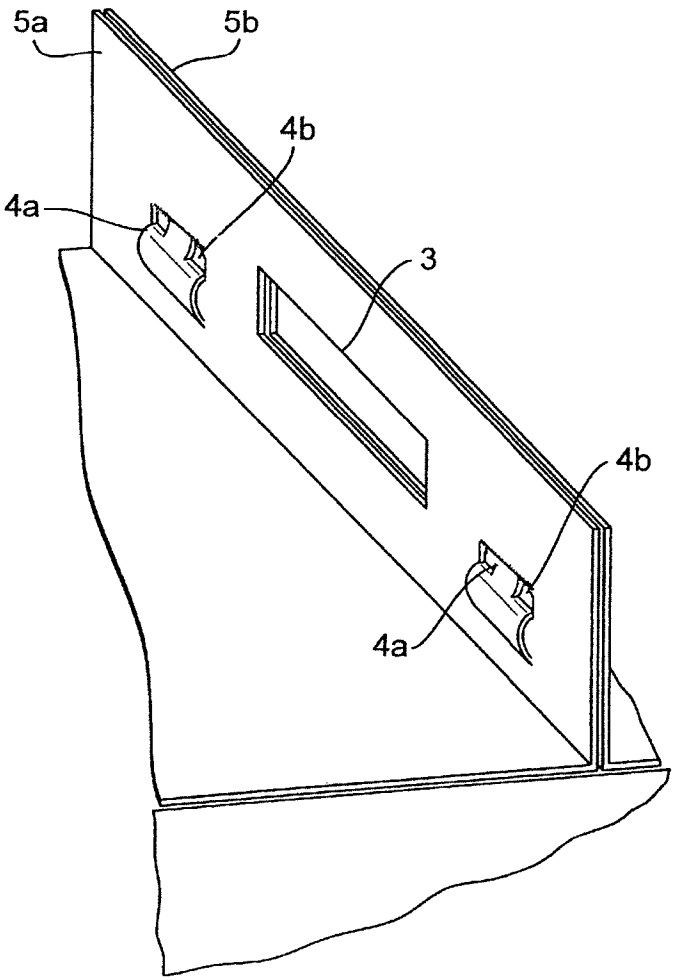
Fig. 5.2
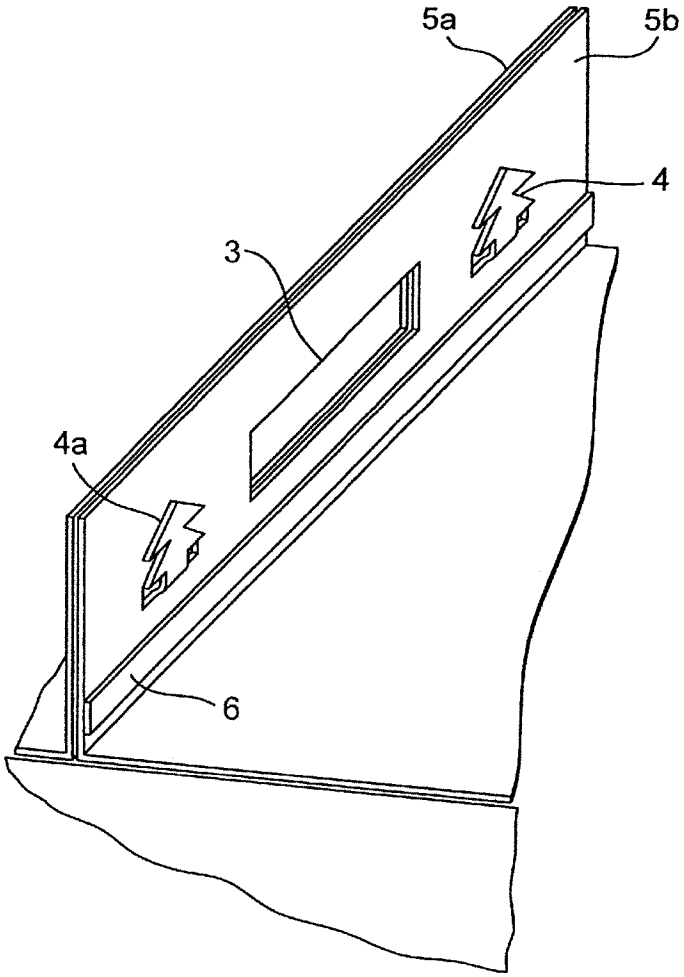

Fig. 6.2
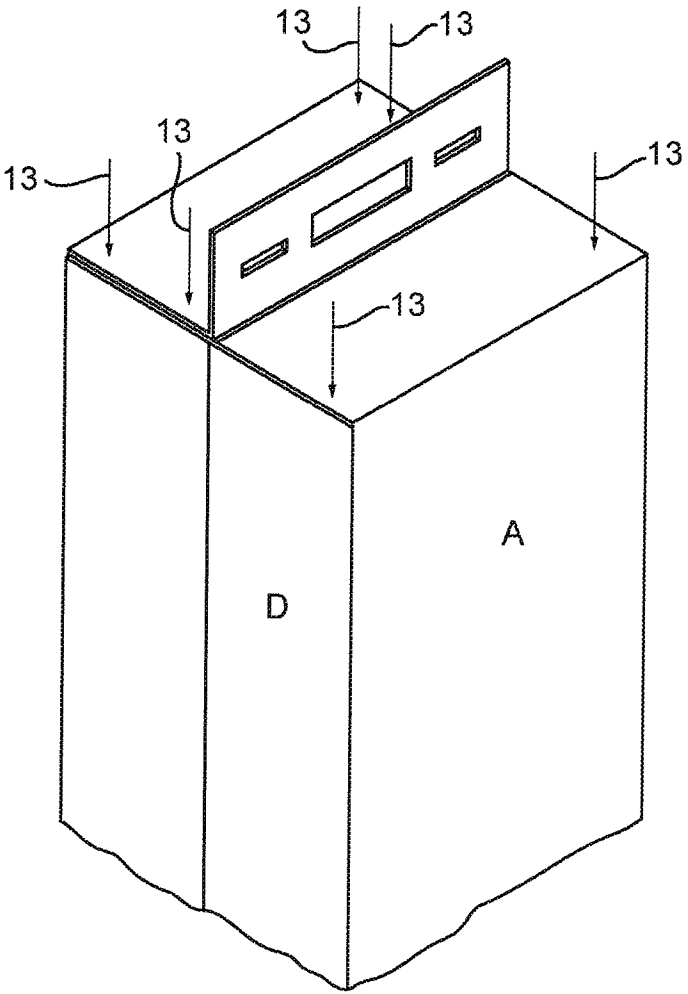
Fig. 6.1
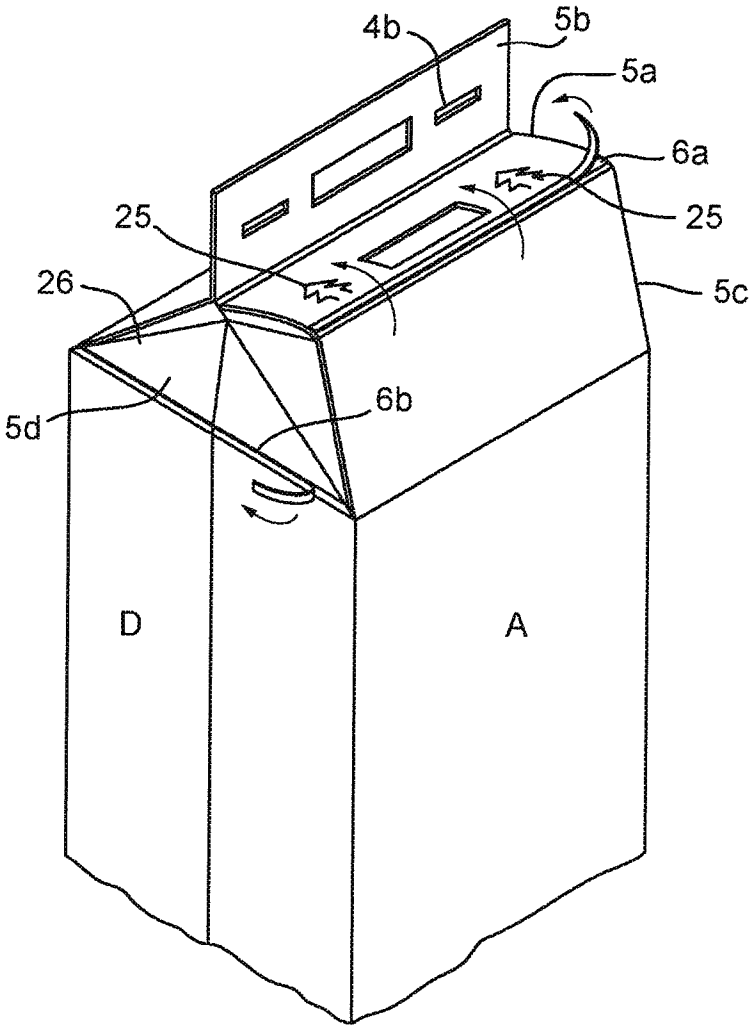

WASTE BIN

CROSS-REFERENCE TO RELATED APPLICATIONS

This application represents the U.S. National Phase of International Application number PCT/GB2016/050237 entitled "Waste Bin" filed 2 Feb. 2016, which claims priority from and the benefit of United Kingdom patent application No. 1501640.5 filed on 2 Feb. 2015 and United Kingdom patent application No. 1511261.8 filed on 26 Jun. 2015.

BACKGROUND TO THE PRESENT INVENTION

Conventional domestic and light commercial waste management systems typically rely upon a system of primary and secondary containment utilising products manufactured from LLDPE (linear low density polyethylene) as primary containers, commonly referred to as bin liners, and from stainless steel and HDPE (high density polyethylene) as secondary containers, commonly referred to as bins and wheelie bins. Systems using primary and secondary waste containers promote the accumulation of bacteria within internal environments, through the permanent retention of secondary waste containers within internal spaces, and after disposal, particularly when refuse is stockpiled. Further, manufacturing of the primary and secondary containers depletes the finite levels of mined and extracted natural resources whilst disposal increases the enduring footprint of global contamination, whether disposal occurs at landfill sites or through alternative means of disposal including combined heat and power.

SUMMARY OF THE PRESENT INVENTION

From a first aspect, the present invention provides a waste container comprising an opening, a permanent closure member, and an adhesive attached to the closure member for irreversibly sealing the closure member to another part of the container so as to permanently close the opening in the container.

For the avoidance of doubt, the irreversible sealing of the closure member to another part of the container so as to close the opening of the container means that the closure member cannot be unsealed without destroying or damaging at least a portion of the container. Permanently closing the opening in the container means that the opening cannot be reopened without destroying or damaging at least a portion of the container. Irreversibly sealing the container allows the user to dispose of the waste container without fear of leakage from the container, or of the container reopening, for instance if it is knocked onto its side. It also allows the user to leave the container undisposed for a time without waste or odours escaping before they dispose of the container.

When the opening of the container is sealed closed by the closure member, the opening may be entirely covered such that the interior of the container cannot be accessed therethrough.

When the opening of the container is sealed closed by the closure member, the container may be closed such that there are no openings through which the interior of the container can be accessed.

When the opening is sealed closed by the closure member, the container may be sealed closed in a watertight and/or gas-tight manner. The container may be considered to be sealed in a watertight and/or gas-tight manner when the pressure inside the container is atmospheric or ambient pressure.

The irreversible sealing means may comprise multiple strips and/or types of adhesives.

The adhesive(s) used as the irreversible sealing means may be provided directly to a surface of the closure member, with no additional parts necessary. Further, it lies flat against the surface, so does not interfere with the function of the container prior to its activation, when it is required to irreversibly close the container.

The adhesive(s) may be a double sided adhesive tape joined on one side to the closure member, the other side for engaging said another part of the container.

The closure member may further comprise a peel strip(s) covering the adhesive(s), wherein the peel strip(s) is releasably adhered to the adhesive so as to prevent the adhesive from adhering to other components prior to the peel strip being removed. In use, the peel strip may be removed to enable the adhesive to engage and adhere to said another part of the container so as to irreversibly seal the closure member to said another part of the container to permanently close the opening in the container.

The waste container may comprise a bottom panel for forming a base of the container, at least one top panel for forming the closure member, and at least one side panel for forming a side wall of the container; wherein the bottom panel is irreversibly sealed to at least one of the at least one side panels.

The bottom panel and at least one side panels may be irreversibly sealed together using waterproof joints such as lapped joints. By using waterproof joints, water and other fluids are unable to escape from the container through the joints between the panels, i.e. fluids cannot escape the container except through the opening.

The waste container may be formed from paperboard or cardboard. Paperboard and cardboard are strong, lightweight, easy to process and disposable. The container can thus be easily formed and disposed of. After use, the entire container can be disposed of with minimal environmental impact. Thus, the container can be manufactured, marketed, sold and used as a disposable item: once the container has been filled with waste, it can be irreversibly sealed, and the container along with its contents disposed of. The strength of the paperboard or cardboard enables the container to be self-supporting, and provides rigidity to the structure.

The paperboard or cardboard may be water resistant or waterproof.

The paperboard or cardboard may have a hydrophobic coating or layer to render it waterproof or water resistant. For example, the paperboard or cardboard may be waxed paperboard or cardboard.

The water resistant paperboard or cardboard enables the waste container to be used for wet or moist waste, for example kitchen waste. It prevents moisture soaking into the paperboard or cardboard, which could compromise the integrity of the paperboard or cardboard and, therefore, the container, and also allow liquid to escape from the container, for example to permeate through the bottom or sides thereof, which would be undesirable. Further, if large amounts of liquid or moisture were to permeate into the paperboard or cardboard, the paperboard or cardboard would lose its rigidity and structural integrity, potentially causing the container to collapse or the panels or walls thereof to break or have holes formed therein. Providing water resistant paperboard or cardboard eliminates the need for a secondary containment layer, such as a bin liner, e.g. when used for wet or moist waste.

Although the container has been described as being formed from paperboard or cardboard, other material are contemplated. For example, although less desirable, the container may be formed from plastics.

The waste container may be formed from a single blank of material.

The waste container may further comprise a reversible closing mechanism for reversibly closing the opening prior to irreversibly sealing the container with the permanent closure member. This allows a user to reversibly close the container when it is only partially full, for example to prevent the waste therein from being visible, or to block odours emitted therefrom, then reopen the container when desired to put more waste therein. This operation can be completed as many times as necessary, before the waste container is full. The waste container can then by irreversibly sealed using the closure member before being disposed of.

The reversible closing mechanism may close the opening of the container by entirely covering the opening such that it is not possible to access the interior therethough. This may close the opening of the container such that there are no openings through which the interior of the container can be accessed. The mechanism may reversibly close the opening of the container so as to allow the opening to be transferred from the closed state to an open (i.e. not closed) state as many times as desired without destroying or damaging any portion of the container.

The reversible closing mechanism may comprise a reversible closure member and a reversible sealing mechanism for reversibly sealing the reversible closure member to another part of the container so as to reversibly close the opening in the container.

The reversible sealing means may be an adhesive, hook and loop material, or any other kind of mechanical fastener, such as a cooperating tab and aperture that reversibly interlock. The reversible closure member may comprise a first mechanical fastener and said another part of the container may comprise a second mechanical fastener element for cooperating with the first mechanical element to perform the reversible sealing.

The permanent closure member and the reversible closure member may be the same member. Said same member may have the adhesive thereon in addition to the reversible sealing means.

The waste container may comprise a first closure panel and a second closure panel for reversibly closing the opening of the container.

One or more slots or apertures may located on the first closure panel, and one or more tabs may be located on the second closure panel for insertion through the slots or apertures to reversibly close the opening of the container.

The tabs can be inserted through the slots or apertures to close the container. The tabs can then be extracted from the slots or apertures to reopen the container. This operation is reversible and, thus, may be repeated as many times as necessary. This provides a simple resealing device.

One of the first and second closure panels may be said permanent closure member comprising said adhesive, and the other of said first or second closure panels may be said another part of the container.

The first and/or second closure panel may be a top panel for being closed over said opening.

When the container is reversibly sealed, the inside surface of one of the first and second closure panels may contact the inside surface of the other of the first and second closure panels.

When the container is irreversibly sealed, the first and second closure panels may overlap such that the inside surface of one of the first and second closure panels contacts the outside surface of the first and second closure panels.

The first and/or second closure panel may comprise a handle aperture for use as a lifting handle.

The container may have a height selected from the group consisting of: ≥10 cm; ≥20 cm; ≥30 cm; ≥40 cm; ≥50 cm; ≥60 cm; ≥70 cm ≥80 cm; ≥90 cm; and ≥100 cm.

The container may have a height selected from the group consisting of: ≤100 cm; ≤90 cm; ≤80 cm; ≤70 cm; ≤60 cm; ≤50 cm; ≤40 cm; ≤30 cm; and ≤20 cm.

The container may have a width selected from the group consisting of: ≥5 cm; ≥10 cm; ≥15 cm; ≥20 cm; ≥25 cm; ≥30 cm; ≥35 cm; ≥40 cm; ≥45 cm; and ≥50 cm.

The container may have a width selected from the group consisting of: ≤50 cm; ≤45 cm; ≤40 cm; ≤35 cm; ≤30 cm; ≤25 cm; and ≤20 cm.

The waste container may be configured to fold between a folded collapsed state and an unfolded expanded in use state. The waste container can be provided to a user in the collapsed state. The user can then unfold and erect the container into the in use state. The container in the collapsed state has a smaller volume than in the in use state, meaning it can be transported and stored more easily.

The area of the at least one top panel may be greater than the area of the top opening of the container.

The adhesive may form a watertight and airtight seal around the opening such that water and other fluids are unable to escape from the container after the opening has been closed by the permanent closure means.

The container may have at least three side walls and a closure panel extending from the upper edge of each side wall for folding over the opening so as to close the container, and wherein the side edges of each closure panel are connected or sealed to the side edges of the adjacent closure panels.

The container may have at least three closure panels configured to fold over the opening so as to close the container, wherein a first of the closure panels comprises said permanent closure member, and where at least one of the closure panels laterally adjacent to the first closure panel is configured to fold over on itself when said first closure panel is folded over the opening. The container may have at least four side walls. The laterally adjacent closure panels may be joined to different side walls of the container. The at least one laterally adjacent closure panel may comprise a closure member, such as an adhesive, configured to adhere the closure panel to itself whilst folded over on itself.

The connected or sealed side edges may be connected or sealed in such a manner that there is a gas and/or water tight seal between them. This prevents gas and/or water escaping from the container (at least between the closure panels) when the closure panels are closed over the opening.

From a second aspect, the present invention provides a waterproof waste container formed from paperboard or cardboard that is water resistant or waterproof on at least the inside of the container so as to prevent fluid leakage out of the container, said waste container comprising an opening, a permanent closure member, and an adhesive attached to the closure member for irreversibly sealing the closure member to another part of the container so as to permanently close the opening in the container.

The second aspect may have any of the optional features described in relation to the first aspect of the present invention.

The present application is also directed to a folded or collapsed waste container configured to be unfolded or otherwise expanded so as to form the waste container previously described.

The present application is also directed to a blank for forming the waste container previously described, wherein the blank comprises said adhesive.

The present application is also directed to a method of forming the waste container previously described from the blank, wherein the blank comprises at least one side panel, at least one top panel and at least one bottom panel, the method comprising forming the blank into the container by adhering the adjoining surface(s) of the bottom and at least one side panels together.

Although the irreversible sealing means has been described as being an adhesive, it is contemplated that (less desirably) the irreversible sealing means may be another type of irreversible sealing means.

From a third aspect, the present invention provides a disposable waste container constructed using water resistant paperboard, wherein the container is resealable, water tight and resistant, and has an integrated closure panel comprising an adhesive for irreversible sealing.

The container may have any of the optional features described in relation to the first aspect of the invention.

For example, the adhesive may be a double sided adhesive strip.

The container may be self-supporting.

The container may be a rectangular prism.

The container may be formable or formed from a collapsed state.

The container may be constructed from single ply waxed paperboard.

The container may be comprised from waterproof paperboard and constructed using lapped joints so as to be waterproof.

The container may be resealable through the insertion and extraction of serrated tabs through locator slots. The integrated closure panel may be a first closure panel, and the container may further comprise a second closure panel, wherein the serrated tabs are located on the first closure panel, and the locator slots are located on the second closure panel.

The container may be constructed from a single sheet of water resistant paperboard. The single sheet of paperboard may be cut, scored, folded and collapsed.

The present application is also directed to a blank for forming the above described disposable waste container.

The waste container described herein replaces primary and secondary waste containers with a pre-assembled, pop up, re-sealable, self-supporting, single use, waterproof container for the purposes of containing general domestic and commercial waste. The container is weather resistant with a closure panel and a permanent closure member with an adhesive attached thereto for irreversibly sealing the closure member to another part of the container so as to permanently close an opening in the container.

The container may reduce environmental impact arising from the conventional combination of waste management techniques and products through the replacement of waste container manufacturing reliant upon the consumption of finite nature resources with a single product manufactured using environmentally sustainable paperboard.

BRIEF DESCRIPTION OF THE DRAWINGS

Various embodiments of the present invention will now be described, by way of example only, and with reference to the accompanying drawings in which:

FIG. 2.1 shows a side view with cut outs of a waste container formed from the blank of FIG. 1;

FIG. 2.2 shows a side view of a partially constructed waste container formed from the blank of FIG. 1;

FIGS. 3.1 and 3.2, 4.1 and 4.2 show a waste container being formed from the blank of FIG. 1;

FIG. 5.1 shows an embodiment of the waste container in its expanded configuration, the opening being resealably closed;

FIGS. 5.2 and 5.3 show opposing side views of the top portion of the waste container of FIG. 5.1;

FIGS. 6.1 and 6.2 show side views of the top portion of a waste container formed from the blank of FIG. 1.

DETAILED DESCRIPTION OF EMBODIMENTS

Figure 1:
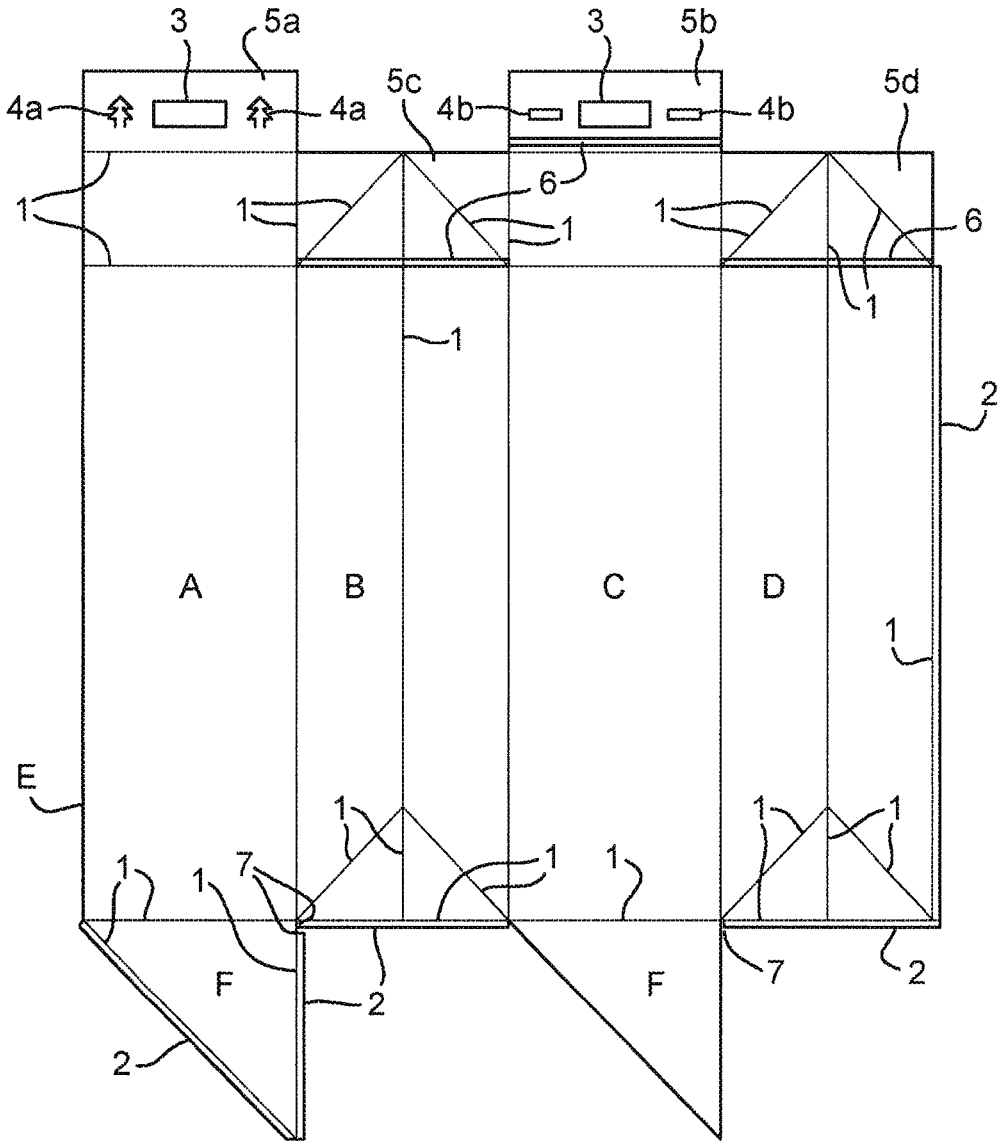
FIG. 1 shows a side view of an embodiment of a blank for forming a waste container.

FIG. 1 shows an embodiment of a blank E for forming a waste container. The blank is a single sheet formed from paperboard. The blank E comprises four elongated side panels A, B, C and D. The panels are connected sequentially along their side edges. The blank further comprises two bottom panels F connected to the ends of side panels A and C. The first bottom panel F is connected to the same end of panel A as the end of panel C to which the second bottom panel F is connected. The blank further comprises a first closure panel 5*a* and a second closure panel 5*b* connected to side panels A and C at the opposite end to bottom panels F. The first and second closure panels 5*a* and 5*b* each have a handle aperture 3 for use as holding handles. The first closure panel 5*a* includes two tabs 4*a*. The second closure panel 5*b* includes two locator slots 4*b* for insertion of the two tabs 4*a* in use, as will be described in more detail below.

Double sided adhesive strips 6, covered by peels strips, are provided on the second closure panel 5*b* and on closure panels 5*c*, 5*d* to attached side panels B and D for irreversible sealing, as will be described in more detail below.

The panels are separated by score lines 1 to aid in the folding of the blank. Further score lines 1 are included in some of the panels to aid in the collapsing of the waste container once formed, as will be described below.

The edges of the blank to be joined to other portions of the blank when the waste container is formed therefrom include portions 2 for forming lapped joints. Cut lines 7 ensure that the blank can be folded where necessary.

FIG. 2.1 shows a side view with cut outs of an embodiment of a waste container formed from the blank of FIG. 1. The blank has been folded along scored lines 1, and adhesive applied to portions 2 to form lapped joints at the jointing surfaces 8, 9, 10, 11 and 12. The side panels A, B, C and D form side walls, and bottom panels F form a base. The blank thus forms a rectangular prism. The shape of the container, along with the material thereof form a self-supporting structure. The lapped joints at the jointing surfaces 8, 9, 10, 11 and 12 form waterproof seals. As such, the container body of the container is watertight.

FIG. 2.2 shows a side view of the waste container of FIG. 2.1 during its assembly from the blank of FIG. 1. Adhesive has been applied to the jointing surfaces 8, 9, 10, 11 and 12 prior to their attachment to other portions of the container.

FIGS. 3.1 and 3.2, 4.1 and 4.2 show a waste container being assembled from the blank of FIG. 1. Firstly, the waste container is formed by adhering the jointing surfaces together, as in FIGS. 2.1 and 2.2. FIG. 3.1 shows a partially constructed waste container, wherein side panels A and D have been adhered together. FIG. 3.2 shows a fully constructed waste container, wherein the bottom panels F have also been adhered both to each other and to side panels B and D. Pressure is then exerted on the vertical scoring lines to collapse the waste container, and the first and second closure panels are folded backwards. This forms a collapsed product ready for storage and transportation, as can be seen in FIG. 4.1. The container can then be prepared for use by an end user by expanding the container out into its expanded configuration, as can be seen in FIG. 4.2. The container has an opening at the end opposite the base formed by bottom panels F. Aside from this opening, the container is waterproof and watertight. The container can then be resealably closed or permanently closed, as described in more detail below.

FIG. 5.1 shows an embodiment of the waste container in its expanded configuration, the opening being resealably closed. The inside surface of the first closure panel contacts the inside surface of the second closure panel 5*b*, and the handle apertures 3 align so as to form a single handle. The tabs 4*a* are then aligned with the slots (not shown) for insertion therethrough (not shown).

FIGS. 5.2 and 5.3 show opposing side views of the top portion of a waste container of FIG. 5.1, wherein the tabs 4*a* are inserted into the slots 4*b*. In the illustrated embodiment, the tabs 4*a* are serrated to aid them to remain securely in the slots 4*b*. The tabs 4*a* can be extracted from the slots 4*b* to reopen the waste container.

FIGS. 6.1 and 6.2 show side views of the top portion of a waste container formed from the blank of FIG. 1. FIGS. 6.1 and 6.2 demonstrate the permanent closure of the opening of the container using the adhesive strips 6*a*, 6*b*. The user removes peel strips from the adhesive strips 6*a*, 6*b* in order to expose the adhesives. The user then folds panels 5*c* and 5*d* along their score lines, and folds the first closure panel 5*a* underneath the second closure panel 5*b* (FIG. 6.1). Panels 5*c* and 5*d* collapse onto themselves along the score lines. The second closure panel 5*b* folds between first closure panel 5*a* and the collapsed panels 5*c* and 5*d*. The user then exerts downward pressure on the top of the container. Adhesives 6*b* irreversibly seal panels 5*c* and 5*d* to themselves. The inside surface of the second closure panel 5*b* contacts the outside surface of the first closure panel 5*a*, and the adhesive 6*a* thereon, and irreversibly seals thereto. Thus, the container is irreversibly sealed, and ready for disposal. The seals formed by the adhesives render the container water and gas tight.

The invention claimed is:

1. A paperboard or cardboard waste container comprising:

an opening, a permanent closure member, an adhesive attached to the closure member for irreversibly sealing the closure member to another part of the container so as to, in use, permanently close the opening in the container; and a reversible closing mechanism for reversibly closing the opening prior to irreversibly sealing the container with the permanent closure member; wherein the reversible closing mechanism comprises a first reversible closure panel and a second reversible closure panel for reversibly closing the opening of the container, and a mechanical fastener; wherein, when the container is reversibly closed by the reversible closing, the inside surface of one of the first and second closure panels contacts the inside surface of the other of the first and second closure panels; and wherein the container is configured such that when the container is irreversibly sealed by the permanent closure member and the adhesive, the first and second closure panels overlap such that the inside surface of one of the first and second closure panels contacts the outside surface of the other of the first and second closure panels such that the other panel is underneath the one panel and the adhesive is between the first and second closure panels.

2. The waste container of claim 1, wherein the adhesive is a double sided adhesive tape joined on one side to the closure member, the other side for engaging said another part of the container.

3. The waste container of claim 1, further comprises a peel strip covering the adhesive, wherein the peel strip is releasably adhered to the adhesive so as to prevent the adhesive from adhering to other components prior to the peel strip being removed.

4. The waste container of claim 1, further comprising a bottom panel for forming a base of the container, at least one top panel for forming the closure member, and at least one side panel for forming a side wall of the container; wherein the bottom panel is irreversibly sealed to at least one of the at least one side panels, wherein the bottom panel and said at least one side panels are irreversibly sealed together using waterproof joints such as lapped joints.

5. The waste container of claim 1, wherein the paperboard or cardboard is water resistant or waterproof, or wherein the paperboard or cardboard has a hydrophobic coating or layer to render it waterproof or water resistant.

6. The waste container of claim 1, wherein the reversible closing mechanism comprises a reversible closure member or panel and a reversible sealing mechanism for reversibly sealing the reversible closure member or panel to another part of the container so as to reversibly close the opening in the container.

7. The waste container of claim 1, wherein one or more slots or apertures are located in the first closure panel, and one or more tabs are located on the second closure panel for insertion through the slots or apertures to reversibly close the opening of the container.

8. The waste container of claim 1, wherein one of the first and second closure panels is said permanent closure member comprising said adhesive, and the other of said first or second closure panels is said another part of the container to which the permanent closure member attaches.

9. The waste container of claim 1, wherein the container has at least three side walls and a closure panel extending from the upper edge of each side wall for folding over the opening so as to close the container, and wherein the side edges of each closure panel are connected or sealed to the side edges of the adjacent closure panels.

10. The waste container of claim 1, wherein the container has at least three closure panels configured to fold over the opening so as to close the container, wherein a first of the closure panels comprises said permanent closure member, and where at least one of the closure panels laterally adjacent to the first closure panel is configured to fold over on itself when said first closure panel is folded over the opening.

11. The waste container of claim 10, wherein said at least one laterally adjacent closure panel comprises a closure member, such as an adhesive, configured to adhere the closure panel to itself whilst folded over on itself.

12. A folded or collapsed waste container configured to be unfolded or otherwise expanded so as to form the waste container of claim 1.

13. A method of using a paperboard or cardboard waste container, said container comprising paperboard or cardboard, an opening, a permanent closure member, an adhesive attached to the closure member for irreversibly sealing the closure member to another part of the container so as to, in use, permanently close the opening in the container, and a reversible closing mechanism for reversibly closing the opening prior to irreversibly sealing the container with the permanent closure member; wherein the reversible closing mechanism comprises a first reversible closure panel and a second reversible closure panel for reversibly closing the opening of the container, and a mechanical fastener; wherein, when the container is reversibly closed by the reversible closing, an inside surface of one of the first and second closure panels contacts an inside surface of the other of the first and second closure panels; and wherein the container is configured such that when the container is irreversibly sealed by the permanent closure member and the adhesive, the first and second closure panels overlap such that the inside surface of one of the first and second closure panels contacts the outside surface of the other of the first and second closure panels such that the other panel is underneath the one panel and the adhesive is between the first and second closure panels, and a mechanical fastener;

wherein the method comprises: contacting the inward surface of one of the first and second closure panels with the inward surface of the other of the first and second closure panels, and using the mechanical fastener to reversibly seal the first and second closure panels so as to reversibly close the opening in the container; and subsequently overlapping the first and second closure panels such that the inward surface of one of the first and second closure panels contacts the outward surface of the other of the first and second closure panels and using the adhesive to irreversibly seal the inward surface to the outward surface so as to permanently close the opening in the container.

* * * * *